US010872595B2

(12) United States Patent
Tiene et al.

(10) Patent No.: US 10,872,595 B2
(45) Date of Patent: Dec. 22, 2020

(54) FLEXIBLE ACOUSTIC WAVEGUIDE DEVICE

(71) Applicant: Bose Corporation, Framingham, MA (US)

(72) Inventors: Michael Tiene, Franklin, MA (US); David Meeker, Acton, MA (US); Chester S. Williams, Lexington, MA (US)

(73) Assignee: Bose Corporation, Framingham, MA (US)

( * ) Notice: Subject to any disclaimer, the term of this patent is extended or adjusted under 35 U.S.C. 154(b) by 312 days.

(21) Appl. No.: 15/878,926

(22) Filed: Jan. 24, 2018

(65) Prior Publication Data

US 2019/0228758 A1 Jul. 25, 2019

(51) Int. Cl.

| | |
|---|---|
| ***G10K 11/22*** | (2006.01) |
| ***H04R 5/00*** | (2006.01) |
| *G10K 11/18* | (2006.01) |

(52) U.S. Cl.
CPC ..... *G10K 11/22* (2013.01)

(58) Field of Classification Search
CPC ..... G10K 11/22; G10K 11/18; H04R 5/033; H04R 5/0335; A61B 7/02; A61B 7/026
See application file for complete search history.

(56) References Cited

U.S. PATENT DOCUMENTS

| | | | | |
|---|---|---|---|---|
| 3,374,856 A | | 3/1968 | Wirt | |
| 4,662,404 A | * | 5/1987 | LeVeen | A61M 39/08 138/120 |
| 5,109,830 A | * | 5/1992 | Cho | A61M 25/0105 600/108 |
| 5,203,319 A | | 4/1993 | Danna et al. | |
| 5,825,895 A | * | 10/1998 | Grasfield | A61B 7/04 381/67 |
| 5,920,038 A | * | 7/1999 | Foster | A61B 7/02 181/131 |
| 6,454,045 B1 | * | 9/2002 | Ryan | A61B 7/02 181/131 |
| 7,712,575 B1 | * | 5/2010 | Moore | A61B 7/02 181/131 |
| 8,818,013 B2 | | 8/2014 | Tse et al. | |
| 9,571,917 B2 | | 2/2017 | Litovsky et al. | |
| 9,736,574 B2 | * | 8/2017 | Litovsky | H04R 5/0335 |
| 9,953,629 B2 | * | 4/2018 | Zalisk | H04R 5/0335 |
| 10,369,328 B2 | * | 8/2019 | Tsai | A61M 25/0108 |

(Continued)

FOREIGN PATENT DOCUMENTS

| | | |
|---|---|---|
| DE | 2741049 A1 | 3/1979 |
| WO | 97/03600 A2 | 2/1997 |

OTHER PUBLICATIONS

The International Search Report and the Written Opinion of the International Searching Authority dated May 11, 2017 for PCT Application No. PCT/US2017/017039.

(Continued)

*Primary Examiner* — Edgardo San Martin
(74) *Attorney, Agent, or Firm* — Brian M. Dingman; Dingman IP Law, PC

(57) ABSTRACT

A flexible acoustic waveguide device with a flexible, unitary band comprising a plurality of acoustic waveguides arranged side-by-side along a length of the band.

21 Claims, 7 Drawing Sheets

(56) References Cited

U.S. PATENT DOCUMENTS

| | | | | |
|---|---|---|---|---|
| 2004/0256172 | A1* | 12/2004 | Darling | A61B 7/02 181/131 |
| 2008/0316864 | A1 | 12/2008 | Klein | |
| 2016/0136393 | A1* | 5/2016 | Tsai | A61M 25/0147 604/510 |
| 2016/0323665 | A1 | 11/2016 | Wickstrom | |
| 2017/0236508 | A1 | 8/2017 | Zalisk et al. | |

OTHER PUBLICATIONS

The International Search Report and the Written Opinion of the International Searching Authority dated Jul. 5, 2019 for PCT Application No. PCT/US2019/014949.

* cited by examiner

FLEXIBLE ACOUSTIC WAVEGUIDE DEVICE

BACKGROUND

This disclosure relates to a wearable acoustic device.

Wearable personal audio devices are able to deliver sound proximate an ear of a wearer, with a device that is adapted to sit on the shoulders or around the neck of the wearer. Examples of wearable personal audio devices are disclosed in U.S. Pat. No. 9,571,917 and U.S. patent application Ser. No. 15/041,957, the disclosures of which are incorporated herein by reference. These wearable personal audio devices are generally "U"-shaped, and are flexible so that they can be placed around the neck and removed, while also generally conforming to the shape of the wearer's torso, or the shape desired by the wearer.

A drawback of some wearable personal audio devices is the complexity of the mechanical structure that accomplishes the adjustable shape. The complexity adds to the cost and may also add to the size of the device.

SUMMARY

All examples and features mentioned below can be combined in any technically possible way.

In one aspect, a flexible acoustic waveguide device includes a flexible, unitary band comprising a plurality of acoustic waveguides arranged side-by-side along a length of the band.

Embodiments may include one of the following features, or any combination thereof. The band may comprise two acoustic waveguides. The two acoustic waveguides may have essentially the same lengths. The two acoustic waveguides may each have a cross-sectional area, and the two cross-sectional areas may be essentially the same. The band may comprise a wall that separate the two acoustic waveguides. The wall may comprise a stiffener. The stiffener may be located along a middle portion of the length of the band. The two acoustic waveguides may be essentially parallel. The flexible acoustic waveguide device may further comprise at least one lumen that extends along the length of the band. The flexible acoustic waveguide device may further comprise at least one of electrical wiring and a stiffening member in a lumen. The wall may be stiffened at one or more locations where there is relatively high acoustic coupling between the waveguides.

Embodiments may include one of the above and/or below features, or any combination thereof. The band may comprise two polymeric materials. The polymeric materials may both be elastomers. The two elastomers may have different hardnesses. The band may comprise alternating segments of the two polymeric materials. Each segment may define portions of each of the acoustic waveguides. The band may comprise an inner portion that defines the acoustic waveguides, and an outer portion that overlies at least some of the inner portion. The inner portion may be made of one polymeric material and the outer portion may comprise a spiral band of the other polymeric material.

Embodiments may include one of the above and/or below features, or any combination thereof. The band may be made by extrusion. The band may be made by molding. The band may be made by multiple-shot molding.

DETAILED DESCRIPTION

The flexible acoustic waveguide device includes a unitary band. The band is unitary in that it is a whole unit. It can be fabricated from multiple parts, but after fabrication it is undivided and exists as a single whole structure that cannot be taken apart without fundamentally altering the waveguide device. The band is flexible. The flexibility provides advantages over a rigid waveguide device. For example, the band can be flexed by a user, so that the device can be positioned on the user's body for example. Also, the flexibility allows the device to be fitted into interior volumes of devices such as loudspeakers that are difficult to fit rigid waveguides into. In some non-limiting examples, the band is extruded or molded from one or more polymer materials, to create the unitary structure.

Figure 1A:
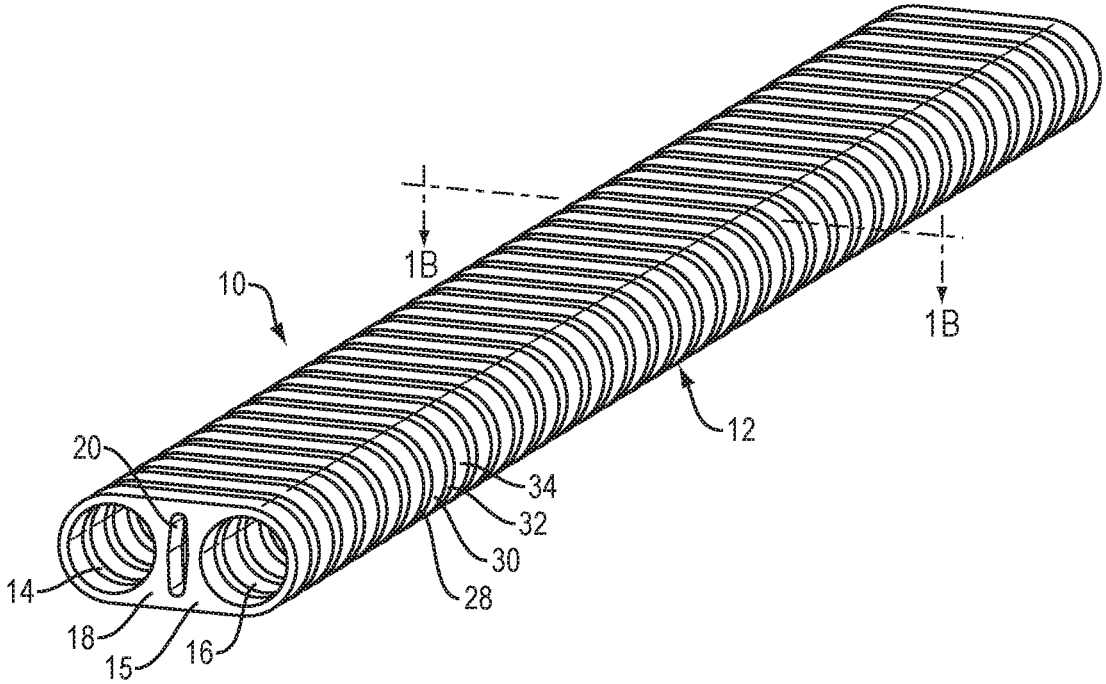
FIG. 1A is a perspective view of a flexible acoustic waveguide device.
Figure 1B:
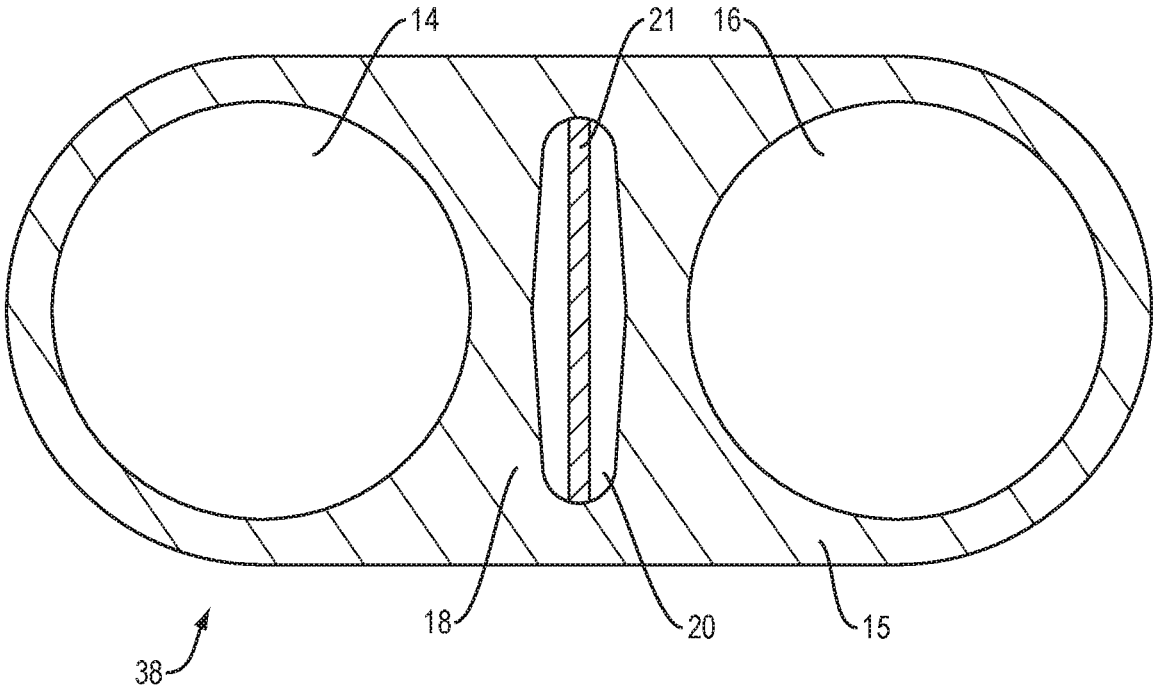
FIG. 1B is a cross-sectional view taken along line 1B-1B, FIG. 1A.

Flexible acoustic waveguide device 10, FIGS. 1A and 1B, includes a flexible, unitary band 12. Band 12 comprises a plurality of acoustic waveguides (in this non-limiting example there are two acoustic waveguides 14 and 16, but the band may comprise more than two waveguides). Waveguides 14 and 16 are arranged side-by-side along the entire length of the band, so that the two acoustic waveguides have essentially the same lengths. The waveguides 14 and 16 may be arranged along a horizontal plane as shown in FIG. 1A, may be stacked vertically, or may be arranged in other physical orientations. Also, the waveguides do not need to be parallel and do not need to extend the full length of the band. The two acoustic waveguides may each have essentially the same cross-sectional area. The acoustic waveguides can have a round cross-section, as shown in section 38, FIG. 1B. The cross-sectional shape of the waveguides 14 and 16 may be other than round, such as an oval, ellipse, circle, oblong, triangle, square, rectangle, or portions thereof.

Band 12 may comprise a unitary (in this example, molded or extruded) body 15 that includes parallel open-ended lumens that define waveguides 14 and 16. Body 15 may also include an additional lumen 20. Lumen 20 in this non-limiting example is located in wall 18 that separates waveguides 14 and 16. Lumen 20 is essentially parallel to waveguides 14 and 16, and may be shaped to extend the full length of the band. Any electrical wiring needed in band 12 can be run through lumen 20. Also, or alternatively, flexible wires or other structures that can be used to help band 12 to maintain a particular formed shape, as further explained below, can be located in lumen 20.

As explained in more detail below, flexible acoustic waveguide device 10 is particularly adapted to conduct sound in a wearable personal audio device, although the use of the flexible acoustic waveguide device in a wearable personal audio device is not a limitation, as it can be used to provide waveguide functionality in other acoustic applications. When used in a wearable personal audio device, flexible acoustic waveguide device 10 can be worn draped around the back of the neck and over the tops of the shoulders. Audio drivers can be acoustically coupled to the waveguides such that sound pressure from one driver is conducted by one waveguide, and sound pressure from a second driver is conducted by the other waveguide. However, these aspects are not limitations of the flexible acoustic waveguide device, as the flexible acoustic waveguide device can be used as part of other audio devices. For example, the flexible acoustic waveguide device can be used to provide acoustic waveguide functionality in a loudspeaker that includes waveguides, such as the Bose® Wave® system devices available from Bose Corporation, Framingham, Mass., USA. Also, the flexible acoustic waveguide device can include more than two waveguides, and the waveguides do not each have to conduct sound from a single driver.

In order to conduct sound pressure efficiently and effectively, the waveguides should be constructed and arranged to minimally degrade sound quality. Measures of sound degradation include, but are not limited to, loss, and cross-talk (acoustic coupling) between waveguides. Cross-talk can occur when movements of the wall of one waveguide, caused by sound pressure variations in the waveguide that can flex the walls, are coupled to another waveguide. Cross-talk is further described below. Since in device 10 waveguides 14 and 16 are close together, and since device 10 can be made from flexible material(s) (such as one or more polymers), cross-talk can occur. One way to inhibit cross-talk is to strengthen or stiffen the portion of device 10 that lies between the waveguides. In the case of device 10, wall 18 lies between waveguides 14 and 16. Wall 18 can be fabricated so that it is relatively stiff, or it can be stiffened post-fabrication, in order to inhibit cross-talk. Stiffening can be enhanced by the configuration, thickness, and/or material from which wall 18, or more of band 12 than only wall 18, is made. For example, stiffness could be partially or fully accomplished by judicious choice of the material(s) from which band 12 is made and/or by tailoring waveguide wall thicknesses to accomplish a desired stiffness profile. Stiffness can also be enhanced by use of a stiffening member that helps to further stiffen wall 18. In the present non-limiting example, stiffening member 21 is placed in wall 18, for example in lumen 20.

Since sound pressure level (SPL) can be highest at the mid-lengths of the waveguides, stiffening of the band is preferably accomplished at least around the mid-lengths of the waveguides. As one non-limiting example, stiffness around the mid-length of the band can be accomplished by using a stiffer material at the mid-length than at the ends. For example, a softer durometer material can be used toward the ends of the waveguides and a harder durometer material can be used to create the central portion of the band. Stiffness around the mid-length of the band could also be enhanced by making the waveguide walls thicker around the mid-length. However, stiffening construction or features can extend for more of or all of the waveguide lengths. For example, the highest SPLs may not be at the center of the waveguide. More generally, stiffening can be applied where SPL is expected to be sufficiently high to result in acoustic coupling; such stiffening can reduce acoustic coupling. Also, stiffening member 21 need not be located in lumen 20 but could be embedded in wall 18. Member 21 can be placed in band 12 by creating the stiffening member first, and then insert molding it as band 12 is injection molded around member 21. Three-shot molding could also be used. Also, resistive taps or other structures can be built into the waveguides to reduce unwanted resonances. Waveguide structures that reduce unwanted resonances are disclosed in U.S. patent application Ser. No. 15/150,700, filed on May 20, 2016, and entitled "Acoustic Device," the entire disclosure of which is incorporated herein by reference.

Band 12 can be made from a single material, or two or more materials. In one non-limiting example, the band is made from two polymeric materials. Properties of the materials selected include but are not limited to flexibility, comfort (when the band is worn on the body), biocompatibility (when the band is worn on the body), robustness, and acoustic damping. The polymeric materials may both be elastomers, such as liquid silicone rubbers, thermoplastic elastomers (TPE), or thermoplastic vulcanizates (TPV), as several non-limiting examples. Santoprene is one specific non-limiting TPV that can be used. The two materials may have different durometers/hardnesses, so as to achieve a desired stiffness/bending profile along the length of band 12. Generally, the band should be flexible enough to be formed or shaped into a generally "U" shape, while being able to be flexed by the user (e.g., when it is put on and taken off), and it should be stiff enough to sufficiently inhibit cross-talk and loss, such that the waveguide is able to deliver sound of sufficient quality as dictated by the product design.

In one non-limiting example, as depicted in FIG. 1A, band 12 may comprise alternating segments of the two polymeric materials. Each segment may define portions of each of the acoustic waveguides. For example, band 12 can be made from alternating segments (illustrative segments 28, 30, 32, and 34 numbered), where spaced segments 28 and 32 are made from one material and the alternating segments (30 and 34) are made from a second material. Both materials can be elastomers, or one or both materials can be non-elastomer polymers. For example, the harder material may be a plastic such as polypropylene. Also, the two materials can have different hardnesses. Generally, it may be desirable for the hardness of the two materials to be as different as possible, given other design constraints of the flexible acoustic waveguide device.

In one specific non-limiting example, one set of segments is about 3 mm long and made from a first material, and the other set of segments is about 6 mm long and made from a second material. The first material can be harder than the second material, or the second material can be harder than the first material. In one non-limiting example of a segmented band such as shown in FIG. 1A, the longer 6 mm segments are made from a harder material (e.g., an elastomer such as Santoprene with a hardness of around 60 Shore A to around 85 Shore A) and the shorter 3 mm segments are made from a softer material (e.g., an elastomer such as Santoprene with a hardness of around 30 Shore A). The harder material thus constitutes about 67% of the length of the band and the waveguides. This provides stiffness that is effective to keep acoustic coupling between the waveguides (i.e., cross-talk) to a level lower than it would be if more of the 30 Shore A material was used. The shorter segments of softer material provide greater band compliance (ability to form and flex).

Band 12 can be made by two-shot injection molding, a technique that is known in the field of injection molding. The result is a unitary structure. Note that the quantity, size, and arrangement of segments of the two materials can be varied. Also, more than two materials could be used. Also, the first molded material could be run along the entire length of the band (e.g., in or comprising wall 18) to allow for quicker molding fill with fewer mold gates. This would result in a structure where the first molded material forms an inner core and the second molded material is arranged in segments around the first molded material. This could be accomplished, for example, by premolding a part from stiff material that is slid onto the cores of the mold before molding the first shot. This procedure would also eliminate internal flash in the center of the waveguide (flash is very difficult and expensive to remove), reduce coupling between waveguides by stiffening the septum or wall between the waveguides, and would have minimal impact on overall bending stiffness.

Figure 2A:
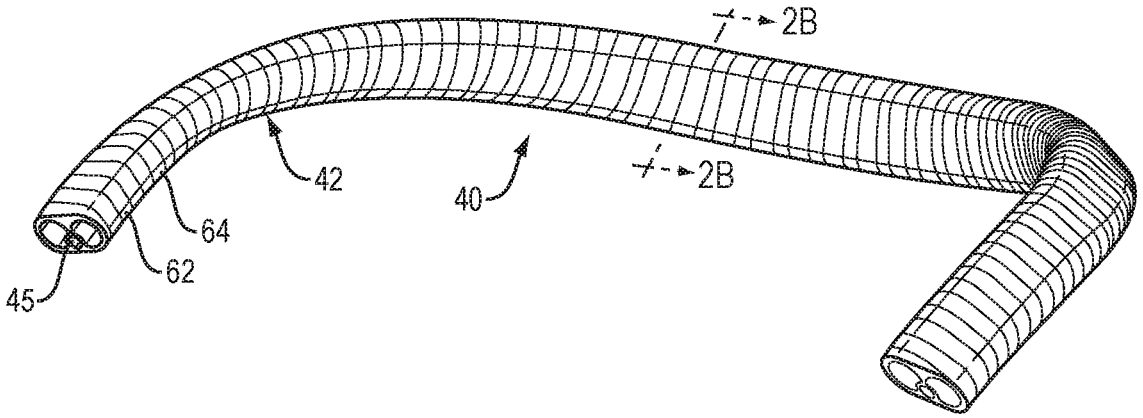
FIG. 2A is a perspective view of a flexible acoustic waveguide device.
Figure 2B:
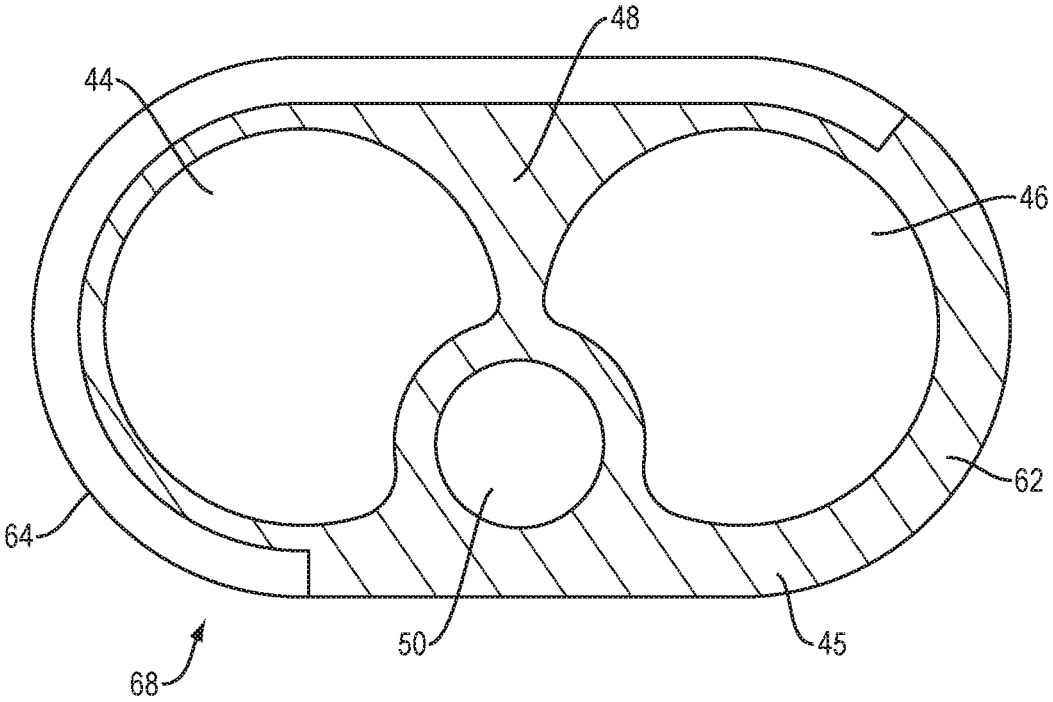
FIG. 2B is a cross-sectional view taken along line 2B-2B, FIG. 2A.

Another example of a flexible acoustic waveguide device is shown in FIGS. 2A and 2B. Flexible acoustic waveguide device 40, FIGS. 2A and 2B, includes a flexible unitary band 42. Band 42 comprises a plurality of acoustic waveguides (in this non-limiting example there are two acoustic waveguides 44 and 46). Waveguides 44 and 46 are arranged side-by-side along the entire length of the band, so that the two acoustic waveguides have essentially the same lengths. The waveguides 44 and 46 may be arranged along a horizontal plane as shown in FIG. 2A, may be stacked vertically, or may be arranged in other physical orientations. The two acoustic waveguides may each have essentially the same cross-sectional areas. The acoustic waveguides can have a round cross-section, as shown in section 68, FIG. 2B. The cross-sectional shape of the waveguides 44 and 46 may also be another shape, such as an oval, ellipse, circle, oblong, triangle, square, rectangle, or portions thereof.

Band 42 may comprise a unitary (in this example, molded or extruded) body 45 that includes parallel open-ended lumens that define waveguides 44 and 46. Body 45 may also include an additional lumen 50. Lumen 50 in this non-limiting example is located in wall 48 that separates waveguides 44 and 46. Lumen 50 is essentially parallel to waveguides 44 and 46, and may be shaped to extend the full length of the band. Any electrical wiring needed in band 42 can be run through lumen 50. Also, or alternatively, flexible wires or other stiff structures that can be used to help band 42 to maintain a particular bent shape, as further explained below, can be located in lumen 50.

Band 42 can be made from a single material, or two or more materials. In one non-limiting example, the band is made from two polymeric materials. The polymeric materials may both be elastomers, such as liquid silicone materials with different durometers. The two elastomers may have different hardnesses, so as to achieve a desired stiffness/bending profile along the length of band 42. In one non-limiting example, as depicted in FIGS. 2A and 2B, band 42 may comprise an inner portion or body 62 made of a first material (e.g., by injection molding), overlaid with a partial covering layer or portion 64 made of a second material, e.g., by injection molding. The molding could be accomplished via a two-shot injection molding process. In this non-limiting example, outer layer 64 is spiral-shaped, in that it encircles the perimeter of inner body 62 in a generally helical fashion. Both materials can be elastomers, and the materials can have different hardnesses. In non-limiting examples, the first material can be harder than the second material, for example as described above relative to FIGS. 1A and 1B. Or, the second material could be harder than the first material. Band 42 can be made by two-shot injection molding, a technique that is known in the field of injection molding. The result is a unitary structure. Note that the width and spiral pattern of outer layer 64 can be varied.

FIG. 2A depicts flexible acoustic waveguide device 40 in a generally "U"-shape, such that it is adapted to sit behind the neck and drape over the shoulders. The shape can be created in the molding process. Or, the shape can be imparted in a subsequent or secondary operation. When device 40 is made from materials that can take a set (such as thermoplastics), this secondary operation can be a heat-set (i.e., thermoforming), where the band is held in a formed or shaped position (e.g., in an appropriate mold or jig) while heated and then cooled. This operation causes the band to deform from a straight configuration (such as shown in FIG. 1A), to a formed configuration, such as shown in FIG. 2A. Band 12, FIG. 1, can also be subjected to such a secondary operation.

Figure 3:
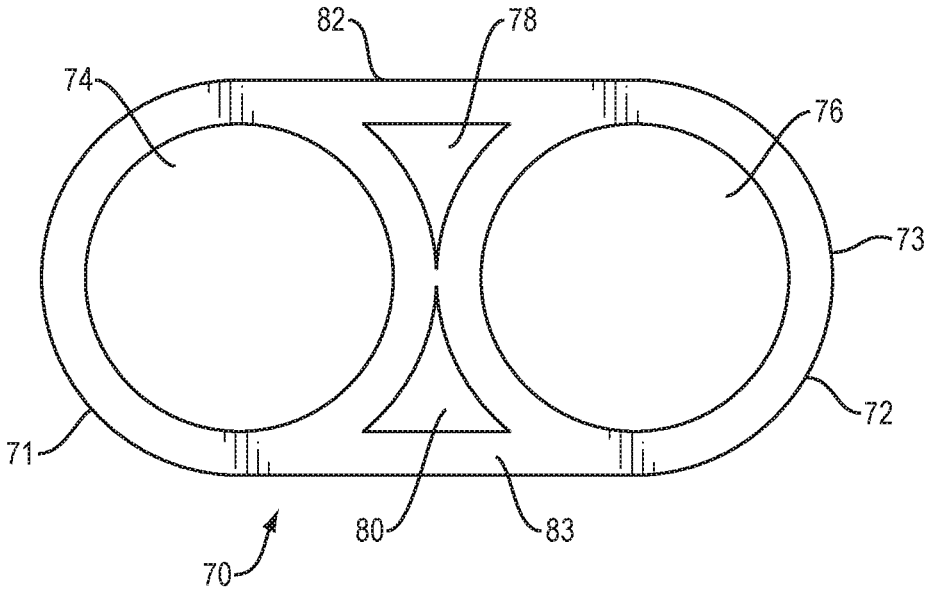
FIG. 3 is an end view of a flexible acoustic waveguide device.

The size, shape, and orientation of the lumens can vary, as can the thickness defining the walls of the lumens, with several additional example alternatives shown in FIGS. 3-7. FIG. 3 is an end view of flexible acoustic waveguide device 70 comprising flexible unitary band 72 that defines lumen 74 inside of tube 71, lumen 76 inside of tube 73, and lumens 78 and 80 defined by exterior wall portions 82 and 83 and the meeting portions of tubes 71 and 73. Lumen 74 is one waveguide and lumen 76 is a second waveguide, and each are substantially circular in cross-section. Lumens 80 and 82 can be used as a conduit for other structures, such as electrical wires or stiffening structures, as described above. Band 72 can have an arbitrary length, as needed for the particular use or application of device 70. Band 72 can be extruded or molded from a plastic material, such as a thermoplastic elastomer.

Figure 4:
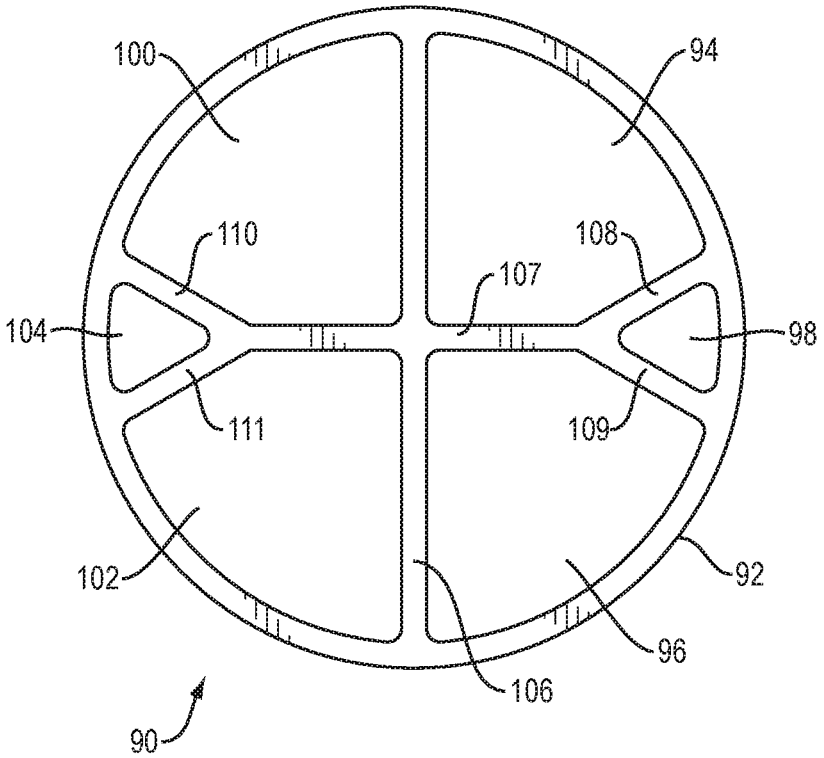
FIG. 4 is an end view of a flexible acoustic waveguide device.

FIG. 4 is an end view of flexible acoustic waveguide device 90 comprising flexible unitary band 92 that defines lumens 94, 96, 98, 100, 102, and 104, which are defined by the open volumes between walls 106, 107, 108, 109, 110, and 111, as depicted in the drawing. Two or more of the lumens can be used as waveguides. Also, two or more of the lumens can be used together as a single waveguide. Note that there is a boundary layer effect in waveguides that reduces the effective acoustic cross-sectional area of the waveguide. Generally, it is understood that the boundary layer extends about 0.1 mm from each boundary (e.g., from each wall making up part of the waveguide). Accordingly, when one or more dimensions of a waveguide approach 0.2 mm, the boundary layer effect can degrade waveguide performance. This is one consideration in determining which lumen(s) to use as waveguides. In one non-limiting example, lumens 94 and 96 are both exposed to the acoustic output of a first acoustic driver and so act as a single waveguide. Similarly, lumens 100 and 102 are both exposed to the acoustic output of a second acoustic driver and so act as a single waveguide. Transverse wall 107 serves to stiffen wall 106 that separates the two waveguides, and so is helpful at reducing acoustic coupling between the waveguides. One or more lumens can be used as a conduit for other structures, such as electrical wires or stiffening structures, as described above. Band 92 can have an arbitrary length, as needed for the particular use or application of device 90. Band 92 can be extruded or molded from a plastic material, such as a thermoplastic elastomer.

Figure 5:
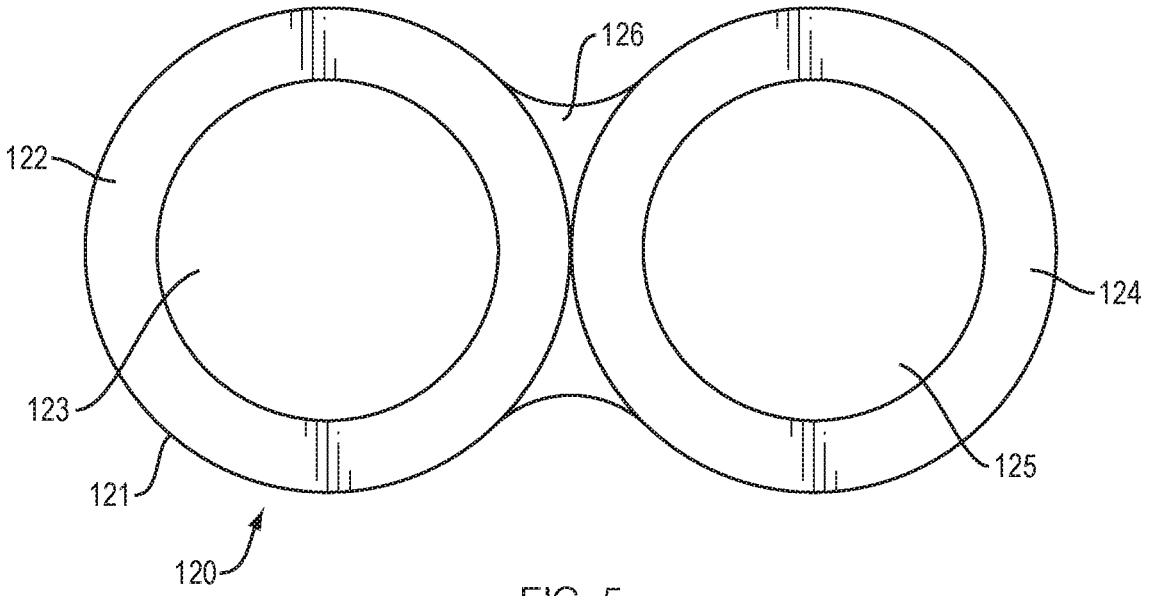
FIG. 5 is an end view of a flexible acoustic waveguide device.

FIG. 5 is an end view of flexible acoustic waveguide device 120 comprising separate (extruded or molded) flexible tubes 122 and 124 (e.g., silicone tubes) that are coupled into a flexible unitary structure/band 121 by silicone adhesive 126. If adhesive 126 is applied while tubes 122 and 124 are held in the desired end shape, when the adhesive sets the band will maintain the desired formed shape. Lumen 123 is defined inside of tube 122, and lumen 125 is defined inside of tube 124. Lumen 123 is one waveguide and lumen 125 is a second waveguide, and each are substantially circular in cross-section. Band 121 can have an arbitrary length, as needed for the particular use or application of device 120. Band 121 can be extruded or molded from a plastic material, such as a thermoplastic elastomer.

Figure 6:
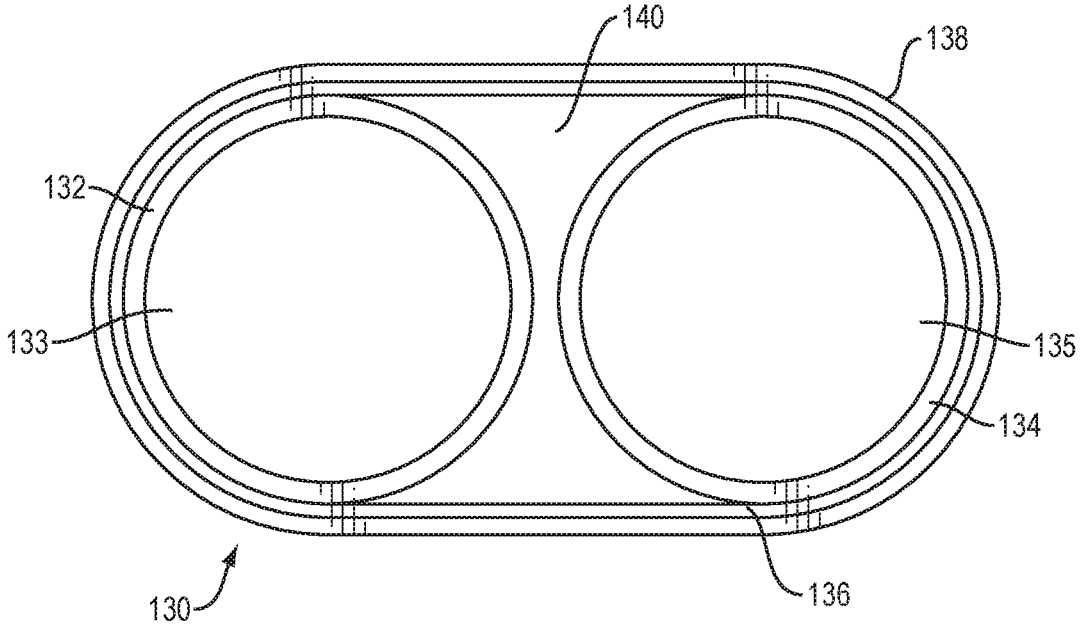
FIG. 6 is an end view of a flexible acoustic waveguide device.

FIG. 6 is an end view of flexible acoustic waveguide device 130 comprising separate flexible tubes 132 and 134 that define waveguides 133 and 135, respectively. Tubes 132 and 134 may be in one non-limiting example wire-wrapped or nylon-wrapped extruded polyvinyl chloride (PVC) tubes. Wrapped tubes generally have increased radial stiffness (which is desirable in waveguides) but maintain a low enough bending stiffness to be formed into the final device, as described elsewhere herein. Wrapping can be used in the example of FIG. 6 and in other examples where there is a tube, or multiple tubes, that are fully or partially covered, such as with the examples of FIGS. 2A and 2B. The tubes may be wrapped in nylon-spandex fabric 136 that encircles both tubes, holding them together and also preventing the tubes from touching the mold walls during the overmolding process, which could lead to a thin outer layer that can peel, or even result in a discontinuous outer layer. This assembly can then be overmolded with a plastic such as urethane, to create outer layer 138. The urethane may also fill space 140 between tubes 132 and 134.

Figure 7:
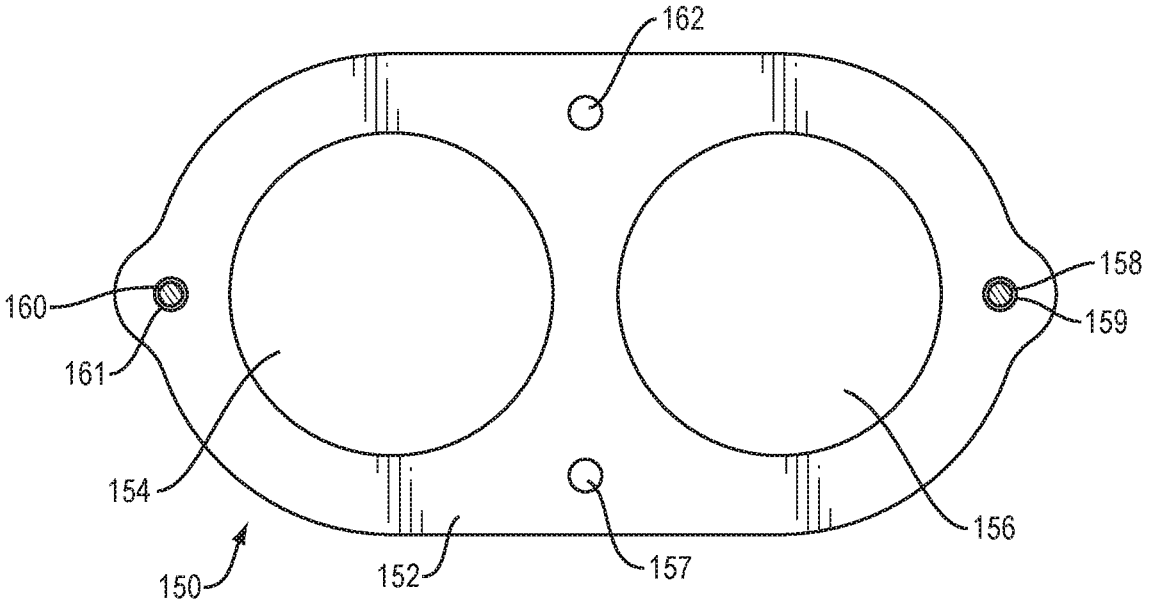
FIG. 7 is an end view of a flexible acoustic waveguide device.

FIG. 7 is an end view of flexible acoustic waveguide device 150 comprising flexible unitary band 152 that defines waveguide lumens 154 and 156. Smaller lumens 157, 159, 161, and 162 can be used as a conduit for other structures, such as electrical wires or stiffening structures, as described above. Depicted in FIG. 7 are wire or cord 158 in lumen 159 and wire or cord 160 in lumen 161. Wires can be used to carry electricity or to impart stiffness and form to device 150. For example, the wires can be spring-tempered steel or another material that is strong but springy. These wires can allow band 152 to be curved into a shape such as that shown in FIGS. 2A and 9. A mechanism (not shown) can be used to lock the wires in place after the band is formed to the desired shape. Band 152 can have an arbitrary length, as needed for the particular use or application of device 150. Band 152 can be extruded or molded from a plastic material, such as a thermoplastic elastomer.

Acoustic coupling or cross-talk between waveguides is generally undesirable and should ideally be minimized. In devices where there are parallel waveguides formed within the same structure, such as disclosed herein, there may be inherent opportunities for problematic acoustic coupling. Some techniques to minimize coupling are described elsewhere herein. In testing of segmented bands such as shown in FIGS. 1A and 1B, and spiral-wrapped bands such as shown in FIGS. 2A and 2B, it was found that the segmented structure had less acoustic coupling than the spiral-wrapped structure. It is believed that this is due to the shared relatively thin central wall or septum 48, FIG. 2B yielding under high pressure, as compared to the thicker central section 18 in FIG. 1B, which is effectively like two walls. Also, it was found that adding an electrical conductor (a wire) in lumen 50, FIG. 2B, reduced coupling by about 2-3 dB.

Figure 8A:
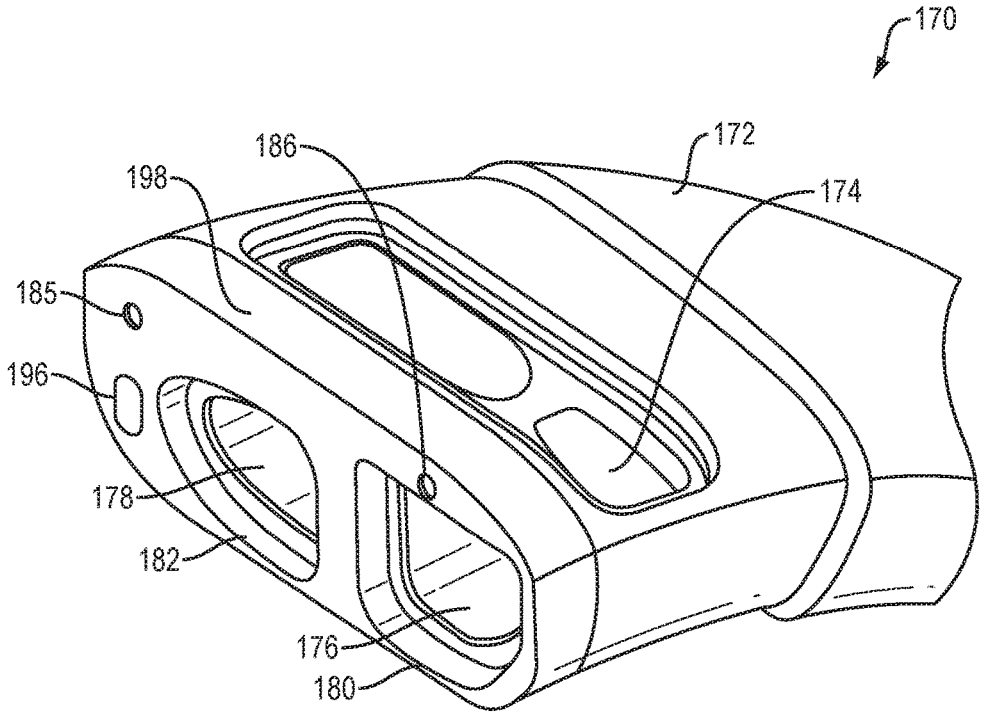
FIG. 8A is a perspective view of a connecting end of a flexible acoustic waveguide device.
Figure 8B:
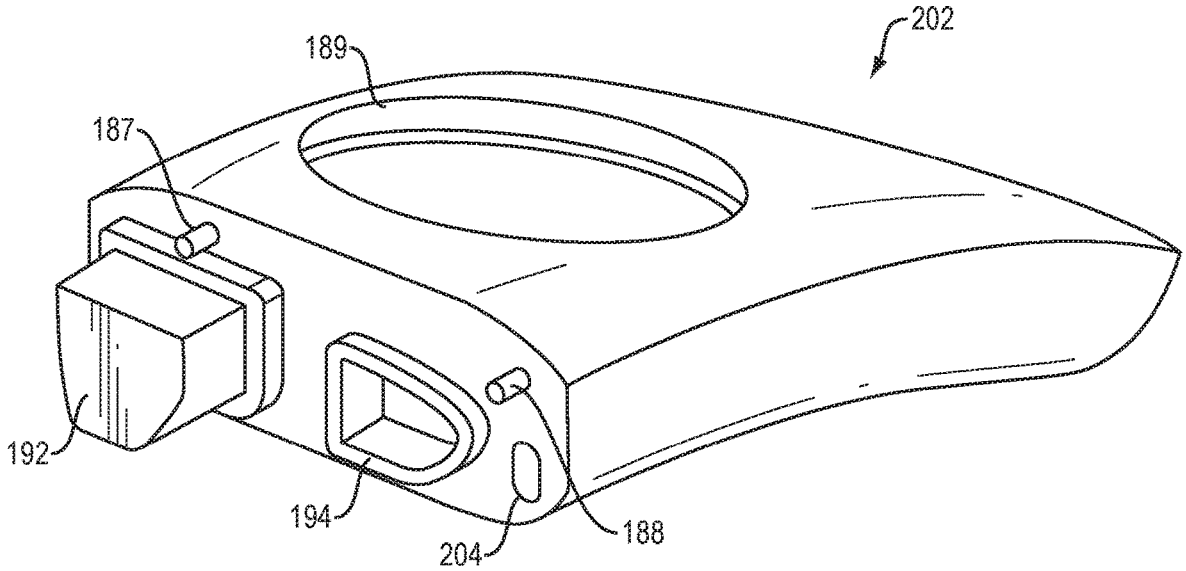
FIG. 8B is a perspective view of a connecting end of an acoustic pod that is coupled to the connecting end of FIG. 8A.

FIGS. 8A and 8B depict perspective views of example connecting ends of flexible acoustic waveguide band 170 and example acoustic pod 202. Pod 202 is one non-limiting device that can be used to carry one or more acoustic drivers and also terminate the one or more waveguides located in the band, and direct sound pressure from the terminated waveguide(s) outward through sound-emitting opening 174, which is located adjacent to the driver. Band 170 and pod 202 are further described in the U.S. patent application Ser. No. 15/041,957 that is incorporated herein by reference in its entirety. Band 170 has end-cap 198 that defines waveguide outlet opening 174 that is at the end of one waveguide. Ramped projection 192 may sit into receptacle 180 at the end of waveguide channel 176 when pod 202 is fitted onto end-cap 198. Ramped projection 192 helps direct sound from the waveguide to outlet opening 174. Chamfer 194 fits into seat 182 of second waveguide channel 178. Fastening screws 187 and 188 fit into receiving holes 186 and 185 to hold pod 202 on band 170, though other fastening mechanisms may be used. One or more acoustic drivers (not shown) sit in opening/receptacle 189. The front side of the driver(s) project sound outwardly, toward an ear of the wearer. The back side projects sound into waveguide 178, by which the sound is conveyed to the second end of the flexible acoustic waveguide device (not shown). Openings 196 and 204 come together and mate, to accomplish a lumen that can be used to carry electrical wiring. Other details of band 170 and pod 202 are set forth in the patent application that is incorporated herein by reference.

Figure 9:
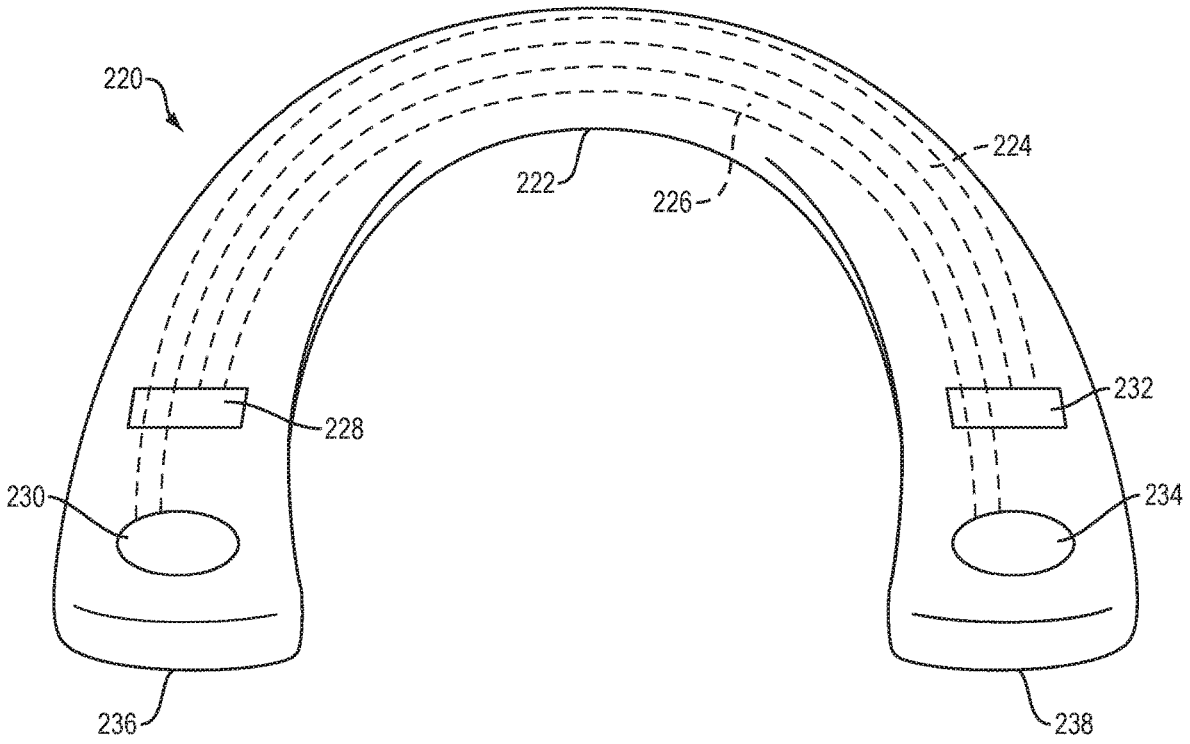
FIG. 9 is a top view of a flexible acoustic waveguide device.

FIG. 9 illustrates an example flexible acoustic waveguide device 220 that comprises flexible band 222 that is coupled at both ends to pods 236 and 238. The functions of pods 236 and 238 are to carry the acoustic drivers (drivers 230 and 234 shown), and couple the back side of the drivers to one (or, more than one) respective waveguides. Sound outlet openings 228 and 232 are also depicted. Sound enters waveguide 224 from the back of driver 230, and exits waveguide 224 via opening 232. Sound enters waveguide 226 from the back of driver 234, and exits waveguide 226 via opening 228. Thus, each driver produces sound directly from one end of device 220 and indirectly, via a waveguide, from the other end of the device. Since this sound comes from the front and back of the same driver, it is out of phase. Note that the pods can be as described above relative to FIGS. 8A and 8B, or the functions of the pods can be accomplished in other manners, as would be apparent to one skilled in the field.

A number of implementations have been described. Nevertheless, it will be understood that additional modifications may be made without departing from the scope of the inventive concepts described herein, and, accordingly, other embodiments are within the scope of the following claims.

What is claimed is:

1. A flexible acoustic waveguide device, comprising:

a flexible, unitary band comprising two acoustic waveguides arranged side-by-side along a length of the band and a wall that separates the two waveguides, wherein the wall is stiffened at one or more locations where there is relatively high acoustic coupling between the waveguides.

2. The flexible acoustic waveguide device of claim 1, wherein the two acoustic waveguides have essentially the same lengths.

3. The flexible acoustic waveguide device of claim 1, wherein the two acoustic waveguides each have a cross-sectional area, and the two cross-sectional areas are essentially the same.

4. The flexible acoustic waveguide device of claim 1, wherein the wall comprises a stiffener.

5. The flexible acoustic waveguide device of claim 4, wherein the stiffener is located along a middle portion of the length of the band.

6. The flexible acoustic waveguide device of claim 1, wherein the two acoustic waveguides are essentially parallel.

7. The flexible acoustic waveguide device of claim 6, further comprising at least one lumen that extends along the length of the band.

8. The flexible acoustic waveguide device of claim 7, further comprising at least one of electrical wiring and a stiffening member in the at least one lumen.

9. The flexible acoustic waveguide device of claim 1, wherein the band comprises two polymeric materials.

10. The flexible acoustic waveguide device of claim 9, wherein the polymeric materials are both elastomers.

11. The flexible acoustic waveguide device of claim 10, wherein the two elastomers have different hardnesses.

12. The flexible acoustic waveguide device of claim 9, wherein the band comprises alternating segments of the two polymeric materials.

13. The flexible acoustic waveguide device of claim 12, wherein each segment defines portions of each of the acoustic waveguides.

14. The flexible acoustic waveguide device of claim 9, wherein the band comprises an inner portion that defines the acoustic waveguides, and an outer portion that overlies at least some of the inner portion.

15. The flexible acoustic waveguide device of claim 14, wherein the inner portion is made of one polymeric material and the outer portion comprises a spiral band of the other polymeric material.

16. The flexible acoustic waveguide device of claim 1, wherein the band is made by extrusion.

17. The flexible acoustic waveguide device of claim 1, wherein the band is made by molding.

18. The flexible acoustic waveguide device of claim 17, wherein the band is made by multiple-shot molding.

19. The flexible acoustic waveguide of claim 1, wherein the band comprises at least one additional acoustic waveguide.

20. The flexible acoustic waveguide of claim 1, wherein the two acoustic waveguides are configured to be acoustically coupled two audio drivers such that sound pressure from one driver is conducted by one waveguide and sound pressure from a second driver is conducted by the other waveguide.

21. The flexible acoustic waveguide of claim 1, wherein the band is formed in a generally "U"-shape.

* * * * *